United States Patent [19]

Liu

[11] Patent Number: 4,920,466

[45] Date of Patent: Apr. 24, 1990

[54] HEADPHONE TYPE ILLUMINATING DEVICE WITH MASSAGE

[76] Inventor: Ju-Fu Liu, No. 298, Tung Ta Rd., Sec. 3, Hsin Tzu City, Taiwan

[21] Appl. No.: 373,434

[22] Filed: Jun. 30, 1989

[51] Int. Cl.[5] ..... F21L 15/14

[52] U.S. Cl. ..... 362/105; 128/32; 128/36

[58] Field of Search ..... 362/105, 103; 128/32, 128/36

[56] References Cited

U.S. PATENT DOCUMENTS

| | | | |
|---|---|---|---|
| 3,478,736 | 11/1969 | Roberts et al. | 128/36 |
| 4,616,297 | 10/1986 | Liu | 362/105 |
| 4,841,954 | 6/1989 | Kalsi | 128/32 |

*Primary Examiner*—Carroll B. Dority

*Attorney, Agent, or Firm*—Varndell Legal Group

[57] ABSTRACT

This invention is related to a headphone type illuminating device with massage means and, more particularly to an illuminating device which comprises a pair of spectacles frame-like supporting members. A pair of lamp cases with illuminating devices secured thereto are respectively connected with a pair of supporting arms for connection therebetween an auxiliary loop. A pair of vibrators which are comprised of motors with eccentric wheels secured thereto are disposed in the pair of lamp cases to vibrate a pair of tapered cushion blocks, which are secured to the pair of supporting members at the inner side, so as to provide massaging effect.

5 Claims, 4 Drawing Sheets

HEADPHONE TYPE ILLUMINATING DEVICE WITH MASSAGE

BACKGROUND AND SUMMARY OF THE INVENTION

Conventional spectacles-like illuminating device is comprising a spectacles frame with a pair of illuminating devices secured thereto at both sides and disposed at a level equal to the eyes of the user.

The U.S. Pat. No. 4,616,297 describes a kind of spectacles-like illuminating device which comprises a frame with a pair of supporting members pivotally connected thereto at both ends, wherein a pair of lamp sockets with lamps disposed therein are respectively secured to a pair of cylindrical members each of which can be pivotally connected to each end of the frame thereby the illuminating direction of the lamp capable of being adjusted to meet the requirements of the user.

This kind of spectacles-like illuminating device has some drawbacks and is not very practical in use, which drawbacks are including the following three points:

(1) Because the device is comprising a transverse frame, it is not suitable for one who is wearing a spectacles.

(2) The two supporting members are fixedly secured to the both ends of the transverse frame, the width therebetween is not adjustable. Therefore, the fixed size can not perfectly fit for all users.

(3) Only single function is provided. The device is designed to provide illumination. No any other function is available.

The main object of the present invention is to provide a headphone type illuminating device with massage means, which includes an adjustable positioning loop to adjust the size to fit for the head of the user.

Another object of the present invention is to provide a headphone type illuminating device with massage means, which can produce illumination and provide massaging effect concomitantly.

A yet further object of the present invention is to provide a headphone type illuminating device with massage means which is practical for users who are wearing spectacles.

The present invention may be fully understood from the following detailed description of the preferred embodiment quoted on the basis of the annexed drawings as hereunder.

DETAILED DESCRIPTION OF THE PREFERRED EMBODIMENT

Figure 1:
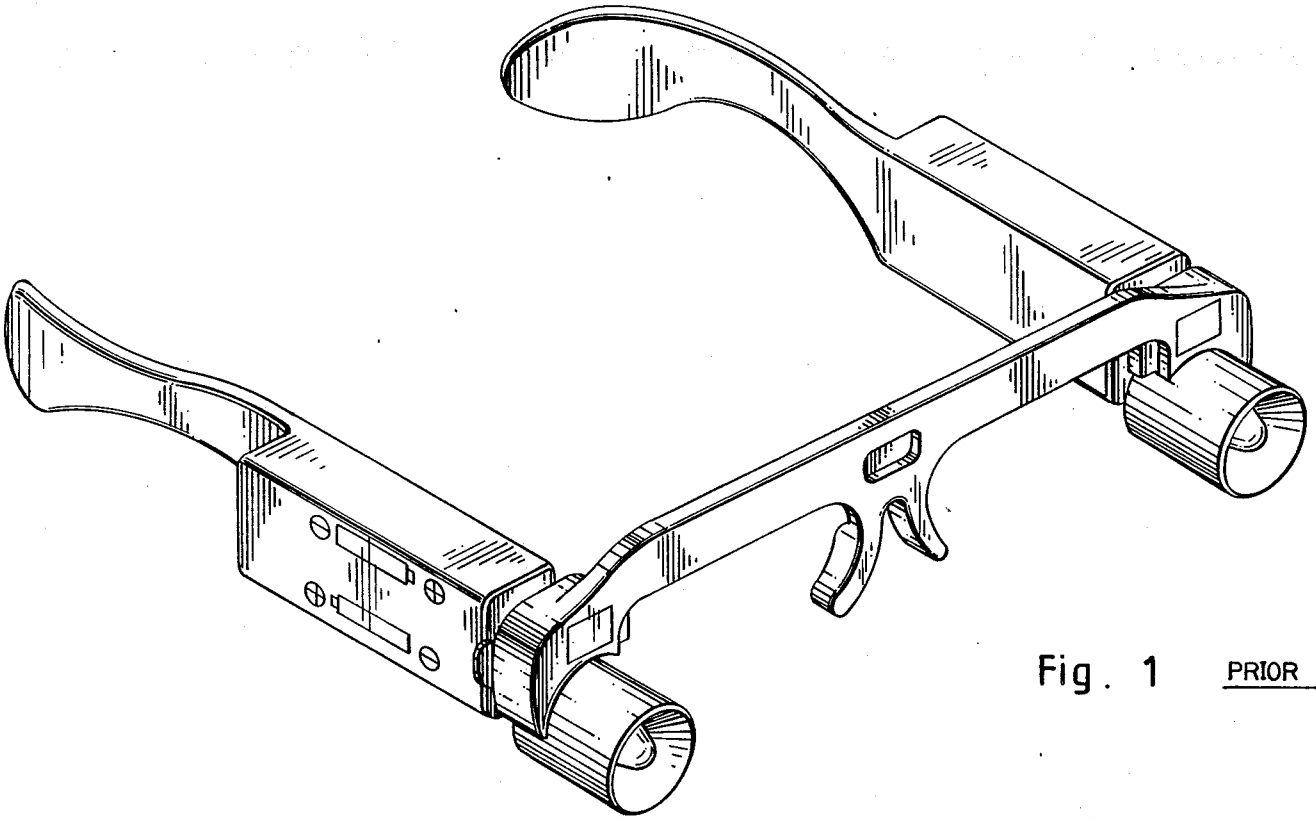
Fig. 1 PRIOR ART
FIG. 1 is a perspective view of the prior art.
Figure 2:
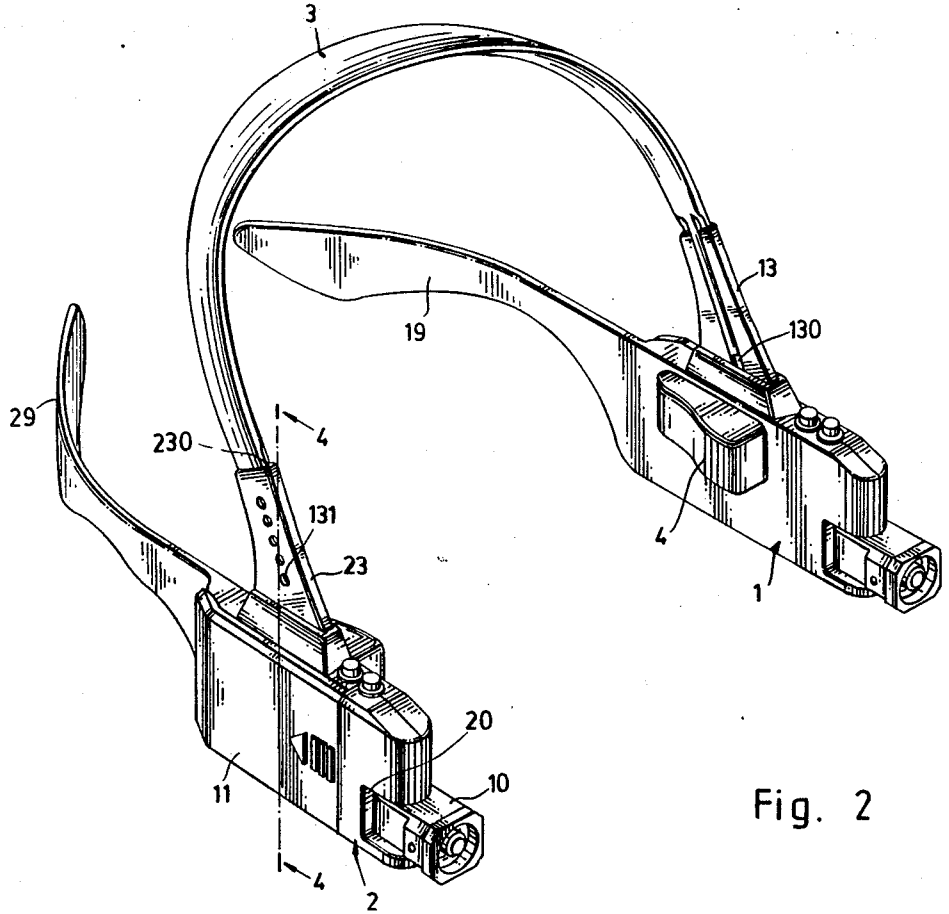
FIG. 2 is a perspective view of the present invention.
Figure 3:
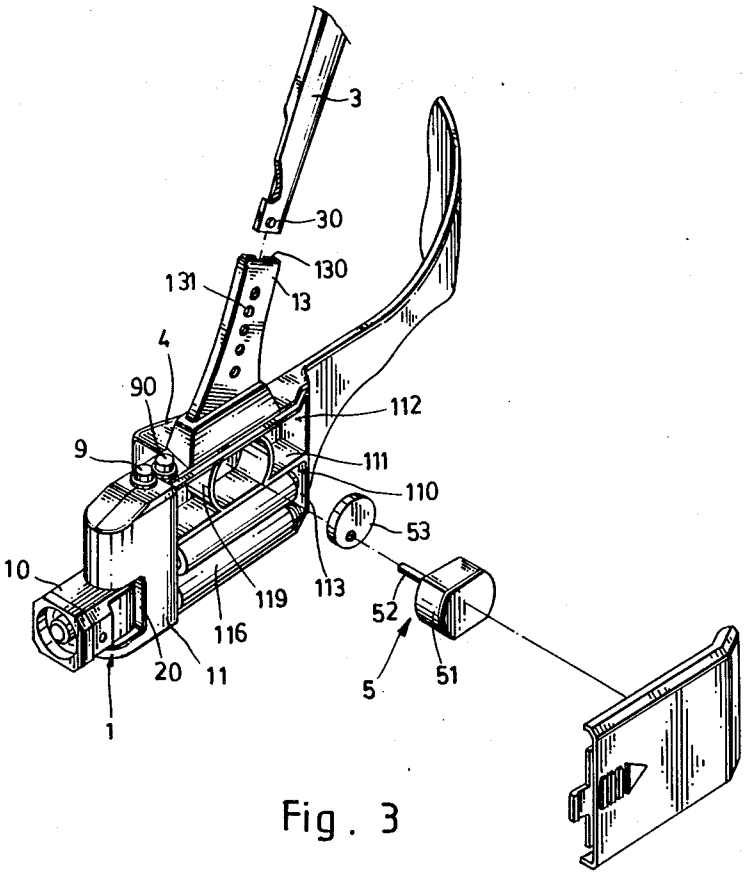
FIG. 3 is a fragmentary structural view of the present invention.
Figure 5:
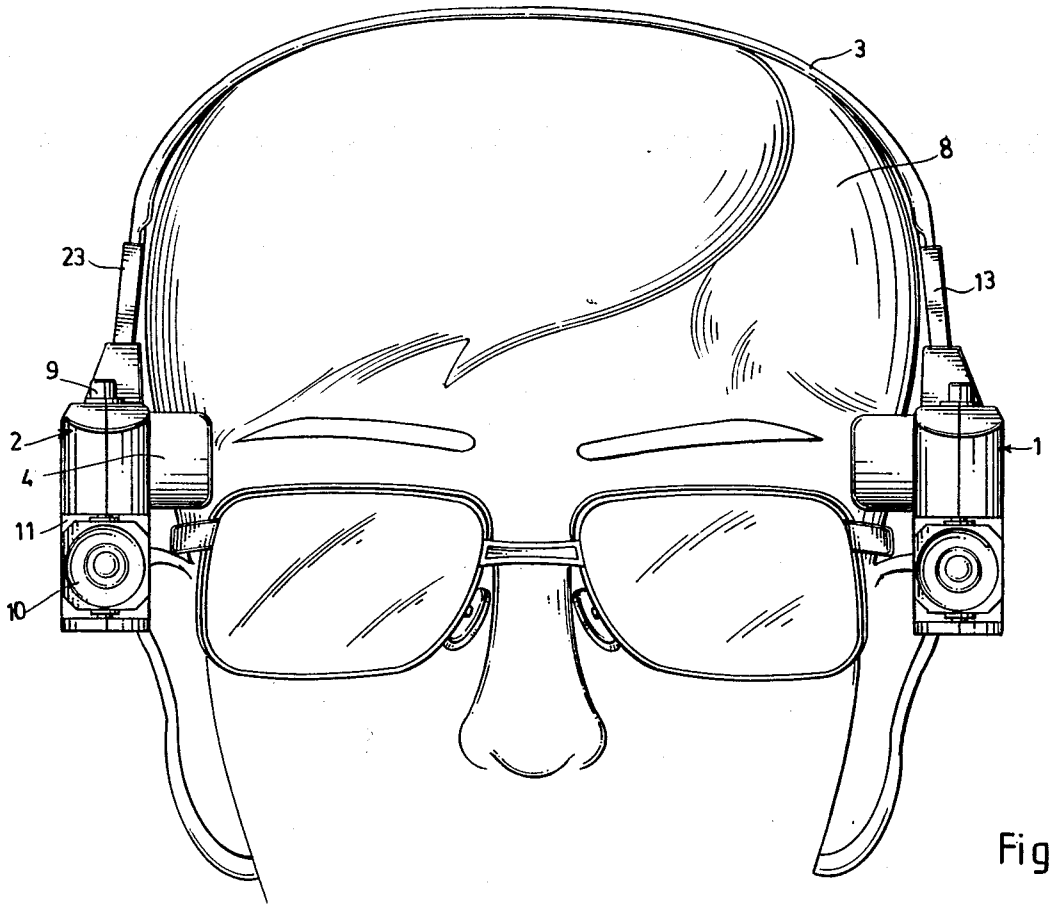
FIG. 5 is a schematic drawing of the present invention when it is in wear.

Referring to FIGS. 2 and 3, a headphone type illuminating device is including a pair of supporting members 1 and 2, an auxiliary loop 3, a pair of cushion blocks 4, and a pair of vibrators 5. The two supporting members 1 and 2 are bilaterally disposed, each having a lamp case 11 set at the bottom for connection thereto of a illuminating device 10, which lamp case 11 is having an inner space 110 (as shown in FIG. 3) divided by a division plate 111 into an upper chamber 112 for setting therein of a vibrator 5, and a lower chamber 113 for setting therein of batteries 116, wherein the illuminating device which is comprised of a lamp socket with a lamp disposed therein and controlled by a press button 9 is pivotally connected to the supporting member 1 or 2 at the notch 20 thereby the illuminating direction of the lamp capable of being adjusted to meet the requirements of the user. The pair of supporting members 1 and 2 are having supporting arms 13 and 23 disposed at the top of the lamp cases 11 and arranged to extend upward in an inclined angle, with several fastening holes 131 made on the side wall respectively, which supporting arms 13 and 23 are having guide tracks 130 and 230 respectively made thereon for insertion therein of the auxiliary loop 3 respectively with both ends to form into a headphone type spectacles frame structure. The auxiliary loop 3 is having several noses 30 set at both ends, such that when the auxiliary loop 3 is respectively inserted into the guide tracks 130 and 230 of the two supporting arms 13 and 23, the noses 30 are adjustably set in the fastening holes 31 to match with the properly engineered curved arms 19 and 29 of the pair of spectacles frame-like supporting members 1 and 2 so as to best fit in with the head of the user and to provide a 3-D positioning effect (that is, top of head, and two lateral sides), as shown in FIG. 5.

Figure 4:
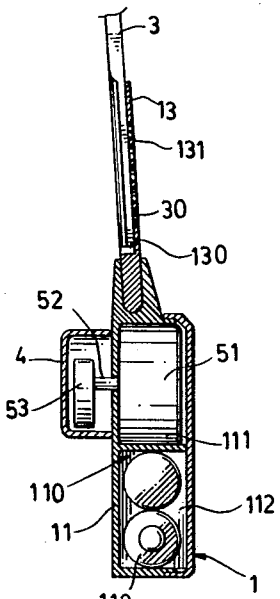
FIG. 4 is a sectional view taken on line 4—4 of FIG. 2.

Referring to FIGS. 3 and 4, the headphone type illuminating device of the present invention also comprises massage means respectively set in the two supporting members to massage the head 8 of the user. As shown in the drawings, a pair of tapered and hollow cushion blocks 4 are respectively secured to the supporting members 1 and 2 at the inner side to aim at the upper chambers 112 of the lamp cases 11 to match with a pair of vibrators 5 which are respectively set in the upper chambers 112 of the lamp cases 11 of the two supporting members 1 and 2. The vibrators 5 are respectively comprised of a motor 51, which is set in the respective upper chamber 112 and firmly retained therein by the division plate 111 and two arch-shaped walls 119 with its revolving shaft 52 connected with an eccentric wheel 53 disposed in the associate cushion block 4. Therefore, when the motor 51 is initiated, the associated eccentric wheel 53 will be driven by the revolving shaft 52 of the motor 51 to synchronously rotate so as to provide vibrate the associated cushion block 4 to massage the contact parts of the head of the user. Through the respective press button 90, the motor 51 can be controlled to rotate concomitantly while the associated illuminating device 10 is providing illumination. According to the present invention, the power supply for the illuminating device 10 can be concomitantly used for the motor 51 or separately arranged.

What is claimed:

1. A headphone type illuminating device with massage means including a pair of spectacle frame-like supporting members to which a pair of lamp cases and a pair of illuminating devices are secured; a pair of supporting arms disposed at the top of said lamp cases and arranged to extend upward in an inclined angle; an auxiliary loop adjustably connected to said pair of supporting arms with both ends; a pair of vibrators and the related power supply means, each power supply means being set in an inner chamber of said lamp cases; a pair of hollow cushion blocks secured to said supporting members at the inner side; wherein said power supply means provide said vibrators with working power of vibrate said cushion blocks to produce massaging effect while said illuminating devices are simultaneously or separately arranged to provide illumination.

2. A headphone type illuminating device with massage means according to claim 1, wherein said pair of spectacle frame-like supporting members include curved arms cooperating with said loop to fit a head of the user and to provide a 3-D positioning effect.

3. A headphone type illuminating device with massage means according to claim 1, wherein the inner chamber of each of said lamp cases is divided into a lower chamber for setting therein of said power supply means, and an upper chamber for setting therein of one of said vibrators, said upper chamber having two arch-shaped walls to match with a division plate so as to let the vibrator be firmly positioned therein.

4. A headphone type illuminating device with massage means according to claim 1, wherein said vibrators each includes a motor having a revolving shaft inserted into the associated cushion block with an eccentric wheel secured thereto and disposed in the associated cushion block, and wherein said eccentric wheel is driven by said motor through said revolving shaft to produce a vibrating effect.

5. A headphone type illuminating device with massage means according to claim 1, wherein the said two cushion blocks have a backward tapered configuration and are respectively secured to the said two supporting members at the inner side to respectively aim at the said upper chambers of the said two lamp cases to help positioning when the device is put on the head of the user, and to provide massaging effect when the said vibrators are operating.

* * * * *